US005162611A

United States Patent [19]

Nichols, III et al.

[11] Patent Number: 5,162,611

[45] Date of Patent: * Nov. 10, 1992

[54] FOLDED RIBBON CABLE ASSEMBLY HAVING INTEGRAL SHIELDING

[75] Inventors: Edward L. Nichols, III, Annapolis; Gary Stirk, Grasonville; Palamadi S. Vishwanath, Annapolis, all of Md.

[73] Assignee: SmartHouse, L. P., Upper Marlboro, Md.

[ * ] Notice: The portion of the term of this patent subsequent to Oct. 15, 2008 has been disclaimed.

[21] Appl. No.: 680,115

[22] Filed: Apr. 3, 1991

Related U.S. Application Data

[63] Continuation-in-part of Ser. No. 496,979, Mar. 21, 1990, Pat. No. 5,057,646.

[51] Int. Cl.[5] ..... H01B 7/34

[52] U.S. Cl. ..... 174/36; 174/115; 174/117 F

[58] Field of Search ..... 174/36, 115, 117 R, 174/117 F

[56] References Cited

U.S. PATENT DOCUMENTS

| | | | |
|---|---|---|---|
| 4,123,753 | 10/1978 | Gravert | 174/115 X |
| 4,533,790 | 8/1985 | Johnston et al. | 174/115 |
| 4,767,891 | 8/1988 | Biegon et al. | 174/36 X |
| 4,847,443 | 7/1989 | Basconi | 174/36 X |
| 4,952,020 | 8/1990 | Huber | 174/117 R X |

FOREIGN PATENT DOCUMENTS

| | | |
|---|---|---|
| 213616 | 8/1986 | European Pat. Off. . |
| 3522173 | 7/1986 | Fed. Rep. of Germany . |

*Primary Examiner*—Morris H. Nimmo

[57] ABSTRACT

The present invention provides two ribbon cable for conducting AC power and digital data signals respectively. A pliable insulating material holds together and electrically insulates the conductors on each ribbon cable. Conductive material, such as a conductive foil or conductive plastic serves to shield the electromagnetic interference generated by the transmitted AC power from the data conductors. The ribbon cables are folded in a protective outer jacket so that the conductive material is disposed substantially between the power conductors and the data conductors. This maximizes the electromagnetic interference shielding of the conductive material.

4 Claims, 7 Drawing Sheets

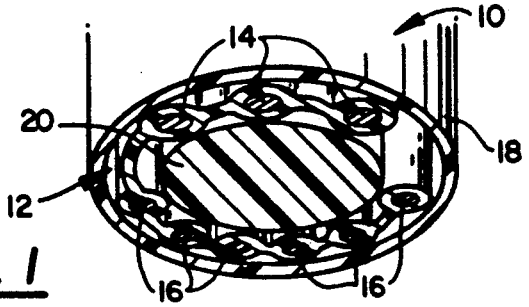
FIG. 1
FIG. 2A
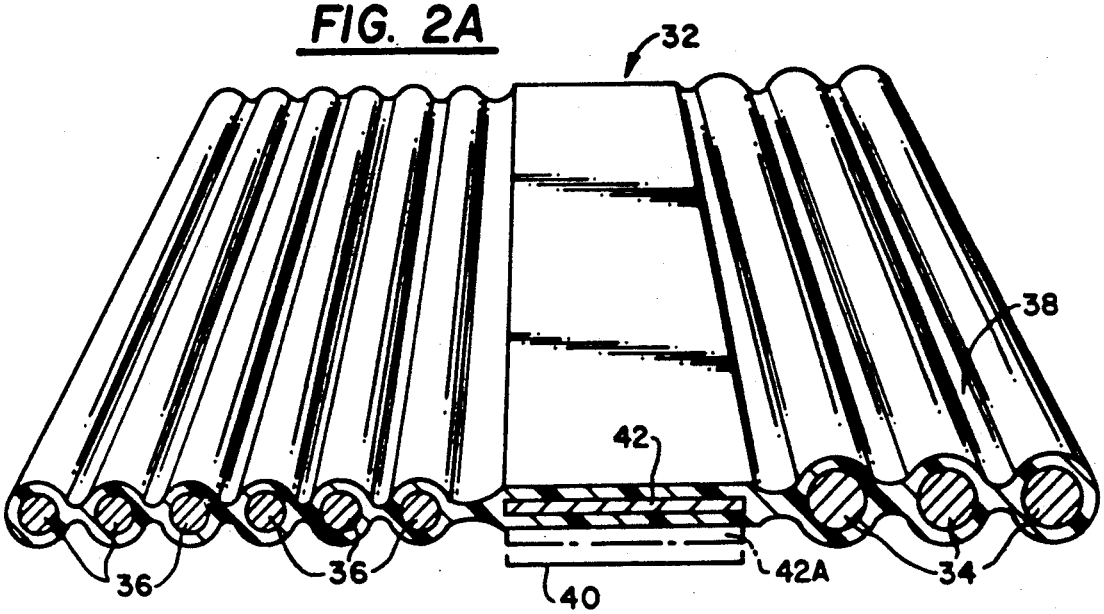
FIG. 2B
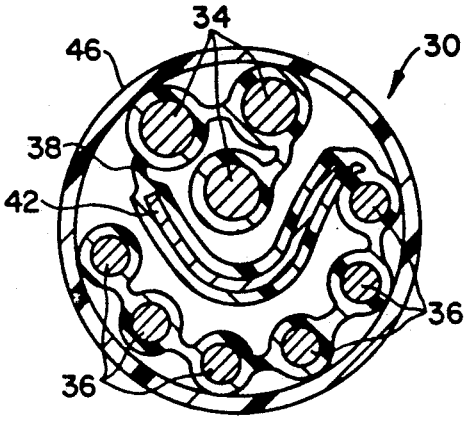
FIG. 3B
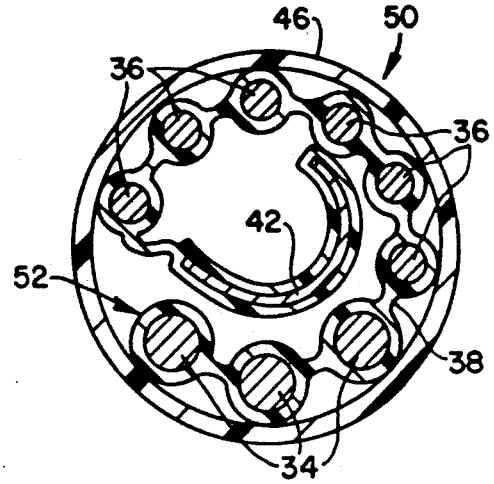

FOLDED RIBBON CABLE ASSEMBLY HAVING INTEGRAL SHIELDING

This application is a continuation-in-part of patent application Ser. No. 496,979, filed Mar. 21, 1990 now U.S. Pat. No. 5,057,646.

BACKGROUND OF THE INVENTION

1. Field of the Related Art

The present invention relates to a ribbon cable assembly having multiple, parallel conductors.

2. Background of the Invention

Many different types of wiring for transmitting various types of electrical signals are known. Depending on the types of signals being transmitted along the wire, different types of wires are known to give the best performance. For example, twisted wire pairs and coaxial cables typically provide better noise immunity than parallel wires and power applications, such as 120 V AC for example, must have a proper gauge to withstand the driven current.

When wiring a new building, such as a residential home, wires used for different purposes are typically wired separately. Thus, telephone wires, security wiring, and power wiring are all installed separately. This is costly to install and difficult to repair once installed.

To provide a more uniform wiring system, the assignee for this application previously developed a wiring topology that integrates different wires used for different purposes on a single ribbon cable assembly, which is the subject of U.S. Pat. No. 5,043,531, bearing and the title "Wiring Layout For Use In Constructing New Homes", which is expressly incorporated by reference into this application.

As illustrated in FIG. 1, this ribbon cable assembly 10 includes a ribbon cable 12 having power conductors 14 with positive, neutral, and ground wires of #12–14 gauge, respectively. Data conductors 16, made of a plurality of #24 gauge wires, are also provided for transmitting digital data communications. This ribbon cable 12 is then folded inside a protective outer jacket 18. Also disposed inside the outer jacket was a protective insulation 20, such as polyethylene, to keep the power conductors 14 and the data conductors 16 spaced apart to improve the signal to noise ratio on the data conductors.

However, it has been determined that the closeness of the power conductors 14 and data conductors 16, as well as the fact that the data conductors 16 are parallel wires, prevents the proper trans mission of digital data along data conductors due to electromagnetic interference generated by the power conductors 14. The presence of the protective insulation was not as effective as required for proper transmission of the digital data along data conductors 16.

Known shielding techniques typically surround the wires to be shielded with a conductive foil or conductive wire mesh. However, this type of shielding is expensive, very labor intensive, and difficult to splice.

SUMMARY OF THE INVENTION

Therefore, it is an object of the present invention to provide a ribbon cable that integrates different wires used for different purposes and also effectively shields these different wires from electromagnetic interference generated from each other.

It is a further object of the present invention to provide a ribbon cable that integrates AC power conductors for transmitting AC power and data conductors for transmitting digital data signals and effectively shields the data conductors from electromagnetic interference generated in the power conductors and shields the power conductors from interference generated by the data conductors.

It is also an object of the invention to provide a ribbon cable assembly that can have different segments of the ribbon cable easily spliced together, even with the shielding on the cable so that insulation displacement connectors inserted into the ribbon cable are not affected by the shielding.

It is still a further object to provide a ribbon cable that can shield the various conductors from electromagnetic interference at a low cost.

To meet the above recited objects, the present invention provides two ribbon cables for conducting AC power and digital data signals, respectively. A pliable insulating material holds together and electrically insulates the conductors on each ribbon cable. Conductive material shields the electromagnetic interference generated by the transmitted AC power from the data conductors. The ribbon cable is folded in a protective outer jacket so that the conductive material is disposed substantially between the power conductors and the data conductors. This maximizes the electromagnetic interference shielding of the conductive material.

BRIEF DESCRIPTION OF THE DRAWINGS

These and other advantages of the present invention may be appreciated from studying the following detailed description of the preferred embodiment together with the drawings in which:

FIG. 1 illustrates a ribbon cable according to the prior art;

FIGS. 2A–2B illustrate a first embodiment of the ribbon cable and the ribbon cable assembly;

FIGS. 3A–3B illustrate a second embodiment of the ribbon cable and the ribbon cable assembly;

DETAILED DESCRIPTION OF THE PREFERRED EMBODIMENT

Figure 3A:
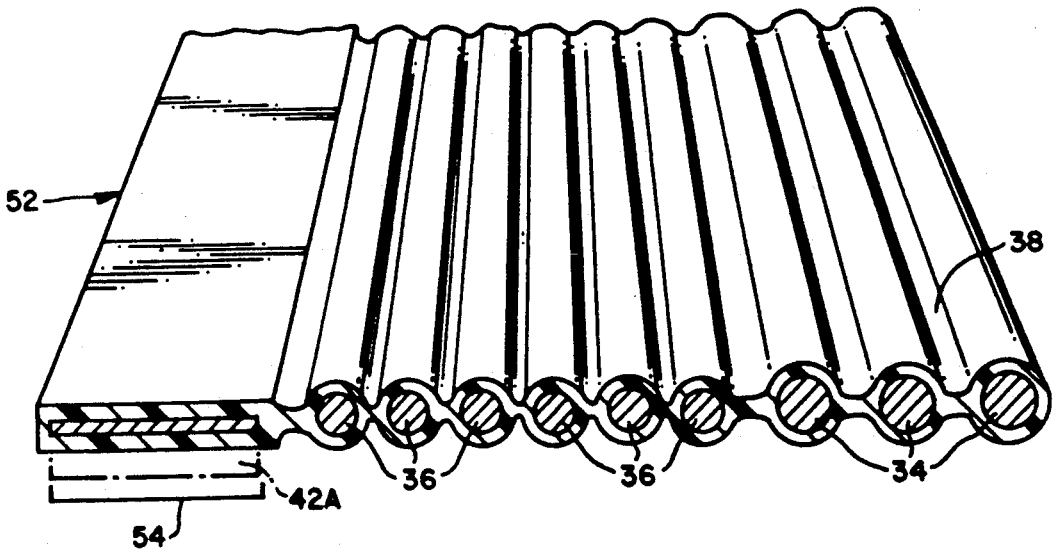

FIGS. 2A–2C illustrates of first embodiment of the present invention, referred to as ribbon cable assembly 30. Ribbon cable assembly 30 includes a ribbon cable 32, having a plurality of parallel conductors including adjacent power conductors 34 and adjacent data conductors 36.

Power conductors 34 capable of transmitting 120 V AC power include positive, neutral and ground wires that are preferably made of #12 gauge copper wire, spaced at 0.25 inch centers, except the outermost "hot"

conductor being spaced 0.35 inches from the adjacent neutral conductor. As illustrated in FIG. 2A, the outermost conductor 34 is the positive, or "hot" conductor, the middle conductor 34 is the neutral conductor, and the other end conductor 34 is the ground conductor.

Data conductors 36 are preferable made of #24 gauge copper wire, are spaced 0.1 inch centers, and are capable of transmitting digital data signals, and clock signals, preferably differentially driven signals.

Each of these conductors 34 and 36 are formed in insulation 38, which is PVC (polyvinylchloride), a pliable plastic, and typically used when making ribbon cables. FIG. 2A further illustrates that between and running parallel to power conductors 34 and data conductors 36 is disposed an area 40 that is used for placement of a conductive shield 42. Conductive shield 42 can be placed within insulation 38 as illustrated in FIG. 2A, or on the outside of insulation 38, as illustrated in dotted line and labelled 42A. In either case, conductive shield preferably has a width of approximately 0.5 inches, the purpose of this dimension becoming apparent hereinafter. However, other widths for varying configurations can also be used. When placed within insulation 38, conductive shield 42 is preferably a flat wire, such as aluminum or copper, or a wire mesh screen having a finer pitch, such as about 33 squares per inch. When mounted on the outside of insulation 38, conductive shield 42A is preferably a copper foil that can be mounted adhesively or with heat or a graphite, nickel conductive paint. A conductive film, embedded in insulation 38 can also be used. The conductive shield 42 or 42A preferably has a thickness of less than 0.001 inches. However, larger thickness, although awkward, could be used. For purposes of manufacture, the conductive foil, which is made up of conductive particles deposited on mylar, mounted on insulation 38 is most preferred.

FIG. 2B illustrates ribbon cable 32 after being folded and placed within outer jacket 46, so that the final form of ribbon cable assembly 30 results. Outer jacket 46 is formed of PVC. Ribbon cable 32 is folded such that the conductive shield 42 is between power conductors 34 and data conductors 36. Outer jacket 46 has a circular dimension that keeps ribbon cable 42 folded in this manner.

The width of conductive shield 42, previously given as about 0.5 inches for the conductor spacings recited, ensures that all of the data conductors 36 are shielded and electromagnetic interference generated by AC power transmitted through power conductors 34 is minimized. The present inventors have determined that the noise level present in the data conductors 36, which originates due to the capacitive effect between power conductors 34 and data conductors 36, is reduced at least 20 Db for frequencies below 250 Khz with conductive shield 42 than the noise level without conductive shield 42. Attenuation of noise decreases as the frequency of the noise increases above 250 Khz.

FIGS. 3A and 3B illustrate the second embodiment of the present invention. For this and later described embodiments, like elements will be labelled similarly. In this embodiment, ribbon cable assembly 50 contains a ribbon cable 52 constructed of power conductors 34 and data conductors 36 that are parallel and mounted in an insulator 38. The difference of this second embodiment is that the conductive shield 42 is not between power conductors 34 and data conductors 36, but instead on the outside end of data conductors 36, in area 54. The resulting ribbon cable assembly 50 performs the same shielding function because conductive shield 42 is disposed between power conductors 34 and data conductors 36. However, ribbon cable 52 must be folded differently inside outer jacket 46. It should also be noted that area 54 could also be disposed at the outside end of power conductors 34.

Figure 4A:
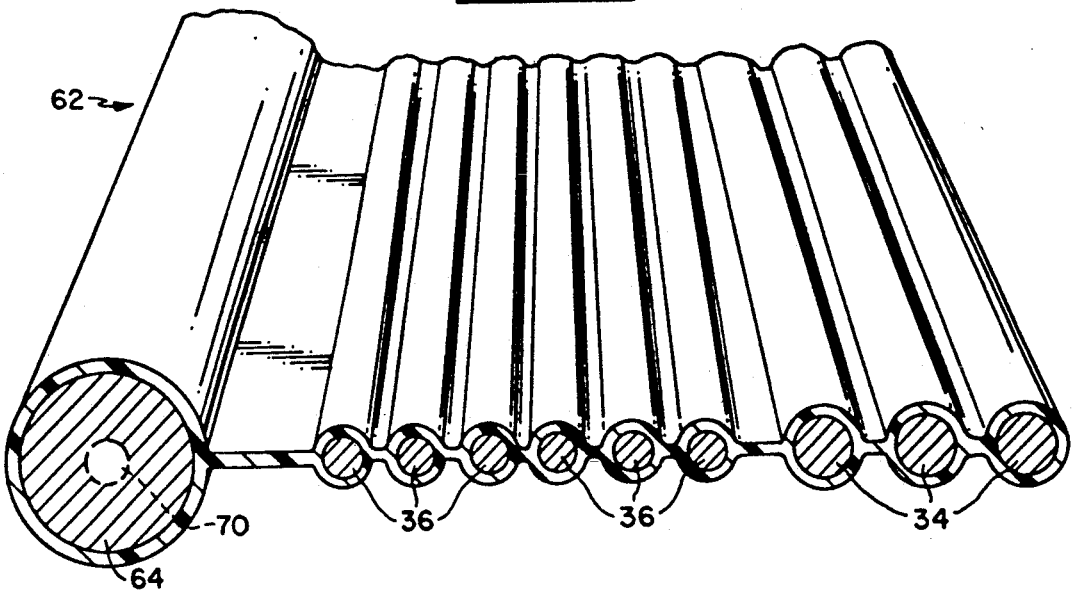
FIGS. 4A–4B illustrate a third embodiment of the ribbon cable and the ribbon cable assembly.
Figure 4B:
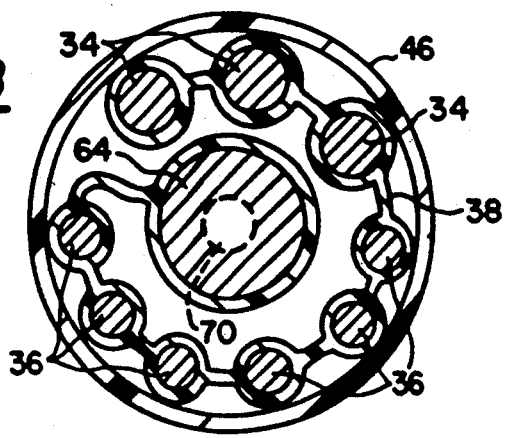

FIGS. 4A and 4B illustrate ribbon cable assembly 60, which is a third embodiment of the present invention. The difference between the second and third embodiment is that ribbon cable 62 includes a cylindrical conductive shield 64 made from a cylindrical conductive plastic having a conductivity of about 0.1 per microhm-cm, which is roughly equivalent to the conductivity of iron. Cylindrical conductive shield 64 has a diameter of about 0.35 inches so that electromagnetic interference, generated by AC power transmitted through power conductors 34, is minimized on data conductors 36 when ribbon cable 62 is folded within outer jacket 46. Once again, these dimensions and conductivity values can change for varying configurations.

Figure 5A:
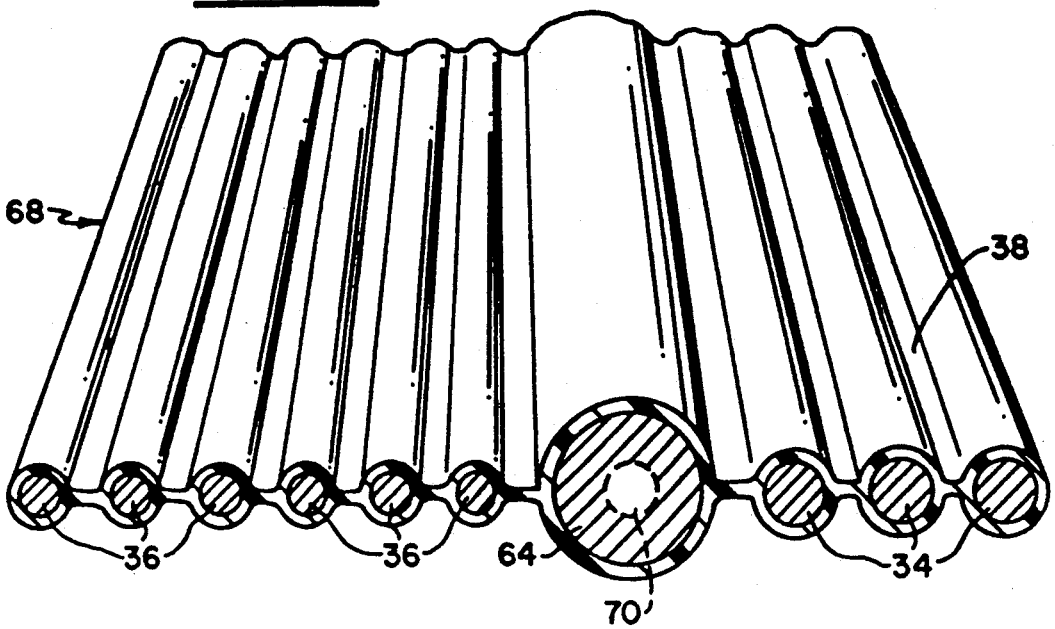
FIGS. 5A–5B illustrate a fourth embodiment of the ribbon cable and the ribbon cable assembly.
Figure 5B:
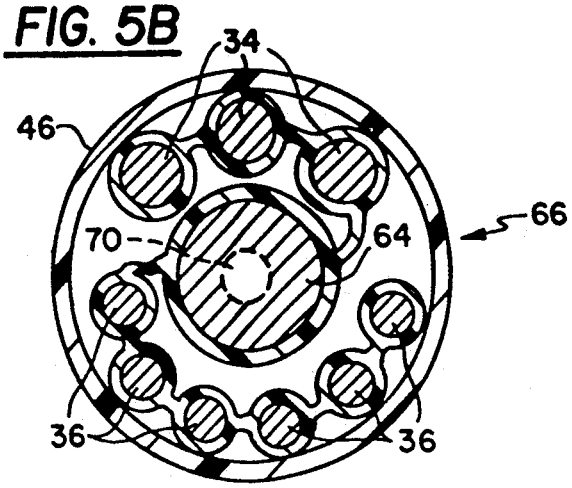

FIGS. 5A-5B illustrates the ribbon cable assembly 66, which is a fourth embodiment of the present invention and is a combination of the first and third embodiments that uses a cylindrical conductive shield 64 as in the third embodiment that is placed in an area 40 as in the first embodiment. The resulting ribbon cable 68 is folded within outer jacket 46 so that the proper placement to minimize electromagnetic interference on data conductors 36 is obtained.

It should be noted that within cylindrical conductive shield 64 there can be placed a copper wire 70 (illustrated in dotted line in FIGS. 4A and 5A), such as a #24 gauge copper wire, to further enhance the shielding effect.

FIGS. 6A-6C and 7A-7B show fifth and sixth embodiment of the present invention, which are labelled ribbon cable assemblies 80 and 90, respectively. Both of these embodiments are similar because they combine the AC ground wire and the conductive shield in a single conductive member.

Figure 6A:
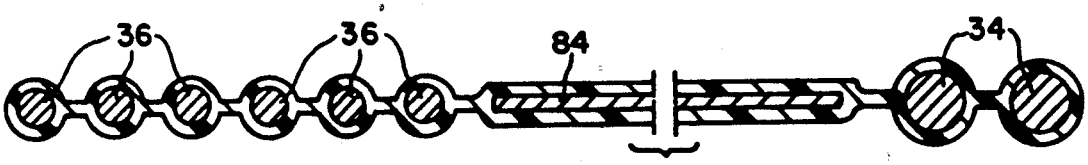
FIGS. 6A–6C illustrate a fifth embodiment of the ribbon cable and the ribbon cable assembly.
Figure 6B:
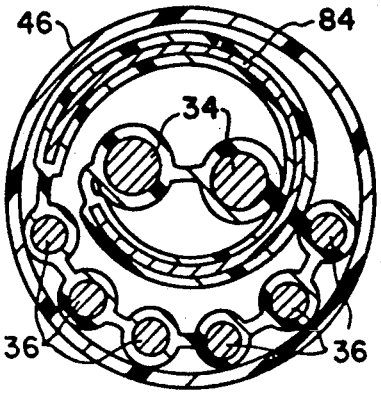
Figure 6C:
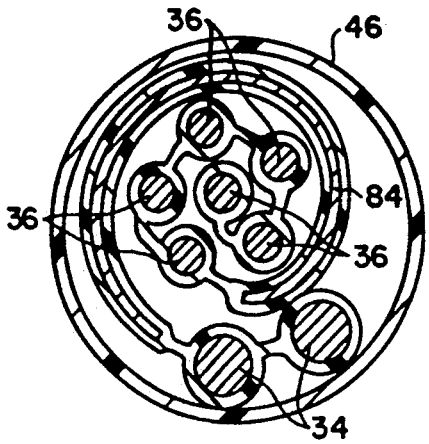
Figure 7A:
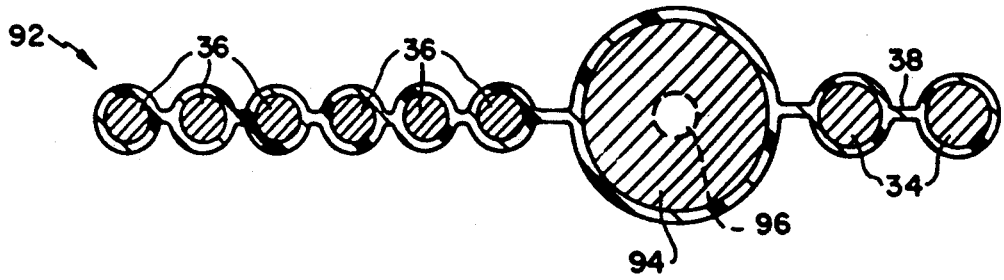
FIGS. 7A–7B illustrate a sixth embodiment of the ribbon cable and the ribbon cable assembly.
Figure 7B:
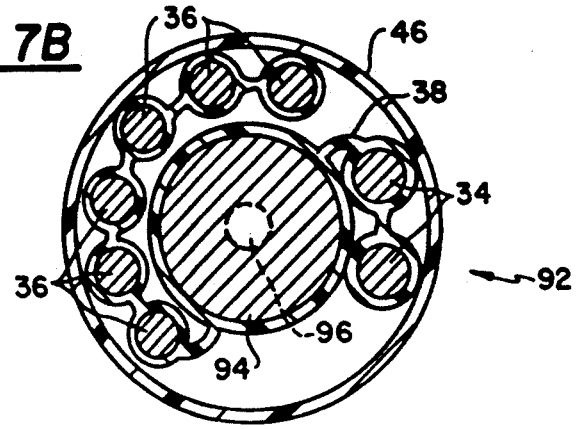
Figure 8A:
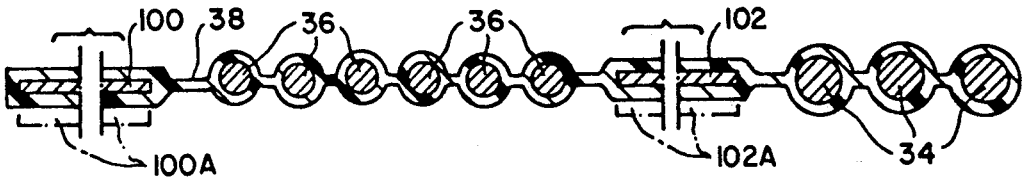
FIGS. 8A–8B illustrate a seventh embodiment of the ribbon cable and the ribbon cable assembly.
Figure 8B:
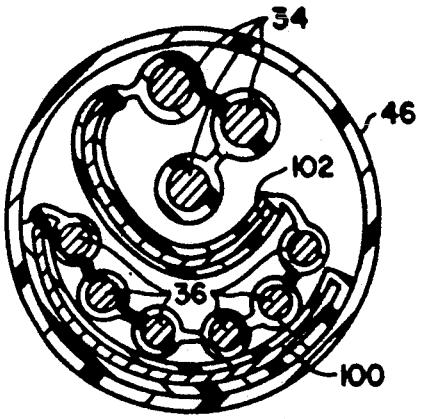
Figure 9A:
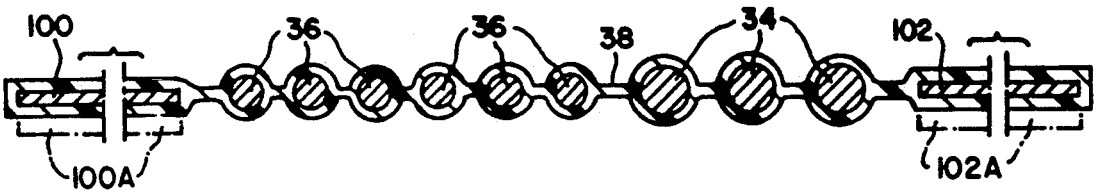
FIGS. 9A–9B illustrate a eighth embodiment of the ribbon cable and the ribbon cable assembly.
Figure 9B:
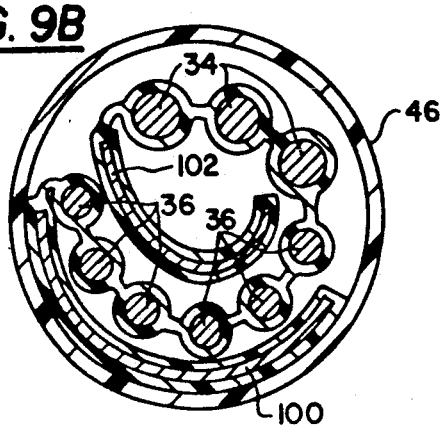

With respect to the fifth embodiment, conductive member 84, which is illustrated in FIGS. 6A and 6B, is a flat cable that electrically is the equivalent of a 14 gauge wire. However, conductive member 84 also has a width that is about 1.2 inches for the spacings recited previously This width, when used with the spacing of 0.25 inches between the positive and neutral power conductors, can fully surround the positive and neutral power conductors to minimize the effect of the electromagnetic interference generated from the positive power conductor on the data conductors 36. FIG. 6C illustrates wrapping data conductors 36 inside conductive member 84.

The sixth embodiment uses a cylindrical conductive member 94 made from a cylindrical conductive plastic having a conductivity that is the same as cylindrical conductive shield 64. Cylindrical conductive member 94, like cylindrical conductive shield 64 illustrated in FIG. 4A, has a diameter of 0.35 inches so that electromagnetic interference, generated by AC power transmitted through power conductors 34, is minimized on data conductors 36 when ribbon cable 92 is folded within outer jacket 46. However, cylindrical conductive member 94 necessarily includes a ground wire 96 having an appropriate gauge, such as 14 gauge copper wire, at its center to provide an effective ground conductor for AC power.

It should be also be noted that in all of the following embodiment that the resulting ribbon cable, such as ribbon cable 32 in the first embodiment, can be easily spliced together. Furthermore, the location of the conductive shield, such as conductive shield 42 in the first embodiment, allows splicing of the conductive shield, as well as the other conductors, without difficulty. One of the reasons that splicing is easy is because it is located in a different area than each of the power conductors 34 and data conductors 36, in contrast to known shielding techniques in which the shield surrounds the conductors, as previously described.

FIGS. 8A–8B and 9A–9B illustrate seventh and eighth embodiments, respectively, which include two conductive shields 100 and 102, or 100A and 102A, which can be formed as either conductive shield 42 or 42A described previously. The location of conductive shields 100 and 102 varies in the seventh and eighth embodiments, as illustrated, but both perform a similar function, which is to isolate both sides of data conductors 36. This further isolation is advantageous in applications where multiple ribbon cable assemblies will be next to each other and the possibility that power conductors 36 from an adjacent ribbon cable assembly could be the source of electromagnetic interference. These embodiments minimize this possibility.

Figure 10A:
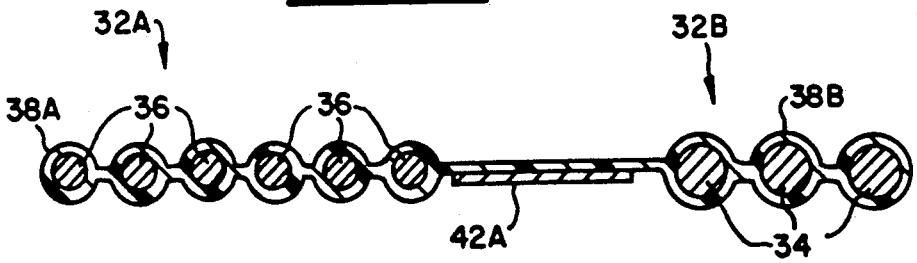
FIGS. 10A–10C illustrate a ninth embodiment of the ribbon cable and the ribbon cable assembly.
Figure 10B:
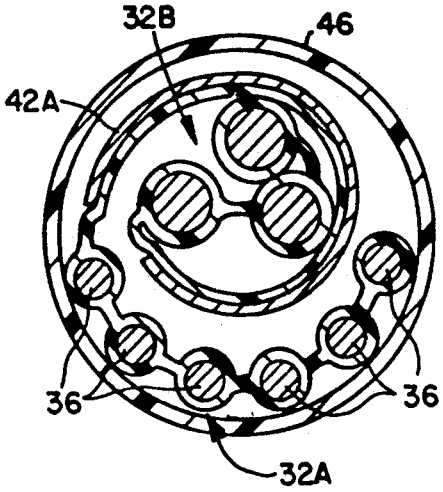
Figure 10C:
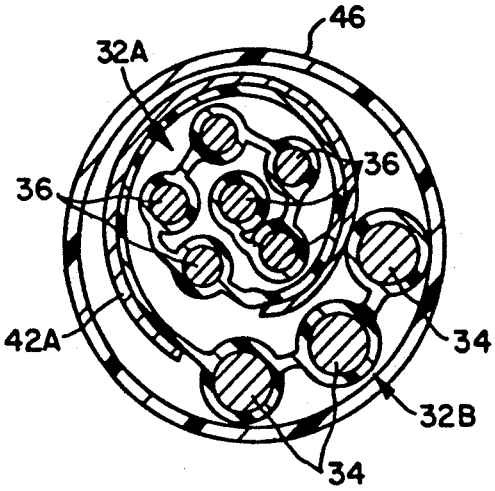

FIGS. 10A–10C illustrate a ninth embodiment of the present invention. It should be noted that the teaching disclosed by this embodiment can be incorporated into all of the previously recited embodiments.

Specifically, as illustrated in FIG. 10A, rather than using a single ribbon cable 32, two different ribbon cable sections 32A and 32B are employed. Ribbon cable section 32A contains all of the data conductors 36, which are held in position with insulating material 38A. Similarly, ribbon cable section 32B contains all of the power conductors 34, which are held in position with insulating material 38B.

Also illustrated in FIG. 10A is conductive shield 42A disposed on the outside of an extended portion of the insulating material 38A. This conductive shield 42 can be attached to the extension of insulating material 38A, but could also be disposed within insulating material 38 as disclosed previously in the other embodiments, and could be positioned without adhering to insulating material 38. The extended plastic portion is not even required and the conductive shield 42A could be positioned between the data conductors 36 and the power conductors 34 without any such extension of the insulating material 38B nor adhering of the conductive shield 42A to the insulating material 38B. Of course, the extension of the insulating material could also be an extension of insulating material 38B and conductive material 42A be disposed on or disposed within such an extension.

FIGS. 10B and 10C illustrated two different manners of folding the ribbon cable sections 32A and 32B within outer jacket 46. FIG. 10B illustrates ribbon cable section 32B folded inside of conductive material 42A and ribbon cable section 32A disposed outside of conductive material 42A. FIG. 10C illustrates folding these sections 32A and 32B in a reverse manner.

Because ribbon cable sections 32A and 32B are separated in this embodiment, manufacture costs are lowered because each ribbon cable section can be manufactured for a lower cost. Of significance is that the ribbon cable section 32B containing the larger power conductors can be run much faster because spacing tolerances are not as critical. The spacing between the data conductors 36 and the power conductors 34 is also not as critical.

Another benefit of the FIG. 10C embodiment is that when installing the ribbon cable of this embodiment, bending of the whole ribbon cable around corners will not cause the smaller data conductors 36 to break. Due to their inner location in the finally folded cable, conductors 36 do not stretch as much as if located in another positions, such as the position illustrated in FIG. 10B.

While the invention has been described in connection with what is presently considered to be the most practical and preferred embodiments, it is understood that the invention is not limited to the disclosed embodiment, but, on the contrary, is intended to cover various modifications and equivalent arrangements included within the spirit and scope of the appended claims.

We claim:

1. A ribbon cable assembly for conducting AC power and digital data signals comprising:

means for conducting AC power comprising:

a first plurality of spaced, parallel, wire conductors arranged in a row, said conductors comprising at least three adjacent power conductors adaptable for conducting said AC power, and a first insulating material for holding together and electrically insulating each of said first plurality of conductors, and means for conducting digital data signals comprising:

a second plurality of spaced, parallel, wire conductors arranged in a row, said conductors comprising at least two adjacent data conductors adaptable for conducting said digital data signals, and a second insulating material for holding together and electrically insulating each of said plurality of second conductors;

means for shielding electromagnetic interference generated by AC power transmitted along said first plurality of conductors from said second plurality of conductors, said shielding means comprising an electrically conductive material arranged parallel to said plurality of wire conductors; and an outer jacket, said conducting means being folded inside said outer jacket so that said shielding means is disposed substantially between said first plurality of conductors and said second plurality of conductors to maximize the electromagnetic interference shielding of said shielding means.

2. A ribbon cable assembly according to claim 1 wherein said second plurality of conductors are folded inside of said shielding means and said first plurality of conductors are folded between said shielding means and said outer jacket.

3. A ribbon cable assembly according to claim 1 wherein said shielding means is disposed on an extended portion of said second insulating material.

4. A ribbon cable assembly according to claim 1 wherein said shielding means is not adhered to either of said first and second insulating materials.

* * * * *